US005422446A

United States Patent [19]

Fries

[11] Patent Number: 5,422,446

[45] Date of Patent: Jun. 6, 1995

[54] PANEL SHAPED ELEMENT, SPECIFICALLY FOR SOUND ABSORBING STRUCTURES AND A SOUND ABSORBING INSTALLATION

[76] Inventor: Arthur Fries, Am see, 6062 Wilen (Sarnen), Switzerland

[21] Appl. No.: 212,210

[22] Filed: Mar. 11, 1994

Related U.S. Application Data

[63] Continuation-in-part of Ser. No. 190,690, Feb. 2, 1994, Pat. No. 5,362,931, which is a continuation of Ser. No. 850,094, Mar. 12, 1992, abandoned.

[51] Int. Cl.[6] ..... E04B 1/82

[52] U.S. Cl. ..... 181/293

[58] Field of Search ..... 181/285, 286, 292, 293

[56] References Cited

U.S. PATENT DOCUMENTS

| | | | |
|---|---|---|---|
| 4,539,245 | 9/1985 | Sarin et al. | 181/292 X |
| 5,024,290 | 6/1991 | Birker | 181/293 |
| 5,362,931 | 11/1994 | Fries | 181/293 X |

FOREIGN PATENT DOCUMENTS

| | | |
|---|---|---|
| 0504629 | 9/1992 | European Pat. Off. . |
| 0445431 | 10/1992 | European Pat. Off. . |
| 2462522 | 2/1981 | France . |
| 2533058 | 3/1984 | France . |
| 733329 | 7/1955 | United Kingdom . |

*Primary Examiner*—M. L. Gellner
*Assistant Examiner*—Khanh Dang
*Attorney, Agent, or Firm*—Ostrolenk, Faber, Gerb & Soffen

[57] ABSTRACT

A sound absorbing panel having a front surface and rear surface, the front surface having a plurality of parallel grooves therein, the rear surface having for each groove in the front surface, a row of bores aligned with respect to the groove, each bore extending into the sound absorbing panel toward the groove with a first diameter to a depth below the depth of the grooves, and thereafter extending with a second smaller diameter into the groove, thereby communicating with the respective one of the grooves, the second diameter being smaller than the width of the grooves.

11 Claims, 13 Drawing Sheets

PANEL SHAPED ELEMENT, SPECIFICALLY FOR SOUND ABSORBING STRUCTURES AND A SOUND ABSORBING INSTALLATION

CROSS REFERENCE TO RELATED APPLICATIONS

This application is a Continuation-In-Part of applicant's U.S. application Ser. No. 08/190,690, filed Feb. 2, 1994, now U.S. Pat. No. 5,362,931, which is in turn a Continuation of Ser. No. 07/850,094, filed Mar. 12, 1992, now abandoned.

BACKGROUND OF THE INVENTION

1. Field of the Invention

The present invention relates to a panel shaped element, specifically for sound absorbing structures and to a sound absorbing installation.

2. Description of the Prior Art

Generally known are panel shaped elements which include through bores. The prior art includes also tube chipboards having grooves at their visible side or offset, continuous slots, resp. Further known are longitudinally and laterally grooved panels whereby the front side is longitudinally grooved and the backside is laterally grooved. Also, known, furthermore, are panels structured of a porous material. All these known panel shaped elements can be varied in relatively restricted limits only in such a manner that they are suitable for a broad spectrum of acoustical problems, specifically for sound protection purposes.

SUMMARY OF THE INVENTION

It is an object of the present invention to provide a panel shaped element, specifically for sound protection installations, in which the respective design of the elements is selectable by a changing of the relevant parameters to cope specifically with their object and with prevailing conditions.

A further object is to provide a panel shaped element which comprises two main surfaces and recesses extending from these main surfaces, which recesses meet each other inside of the element may and partly overlap each other, whereby the recesses of one of the surfaces of the element are of a shape which differs from the shape of the recesses of the other surface in such a manner that the recesses form passages through the element.

The above and other objects of the invention are achieved by a sound absorbing panel having a front surface and rear surface, the front surface having a plurality of parallel grooves therein, the rear surface having for each groove in the front surface, a row of bores aligned with respect to the groove, each bore extending into the sound absorbing panel toward the groove with a first diameter to a depth below the depth of the grooves, thereafter extending with a second smaller diameter into the groove, thereby communicating with the respective one of the grooves, the second diameter being smaller than the width of the grooves.

According to another embodiment, the sound absorbing panel has a plurality of parallel grooves in two orthogonal dimensions, thus forming a plurality of intersecting grooves.

According to another embodiment, the objects of the invention are achieved by a sound absorbing panel having a front surface and a rear surface, the front surface having a plurality of parallel grooves in two orthogonal dimensions, the rear surface having, for each groove in the front surface, a row of bores aligned with respect to the groove, a portion of the bottom of each bore opening into and communicating with the respective one of the grooves, the bottom of each bore opening into and communicating with the respective one of the grooves having a diameter at a point of intersection with a respective groove which is larger than the width of the groove, the bores being located at intersections between the orthogonal grooves.

According to yet a further embodiment, the objects of the invention are achieved by a sound absorbing panel having a front surface and a rear surface, the front surface having a plurality of first bores therein which do not extend completely through the panel, the rear surface having for each first bore in the front surface a respective second bore having a diameter larger than the diameter of the first bore aligned with and centered with respect to the first bore, a portion of the bottom of each second bore opening into and communicating with the respective one of the first bores.

Still a further object is to provide a sound absorbing installation having a plurality of such panel shaped elements.

BRIEF DESCRIPTION OF THE DRAWINGS

The present invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
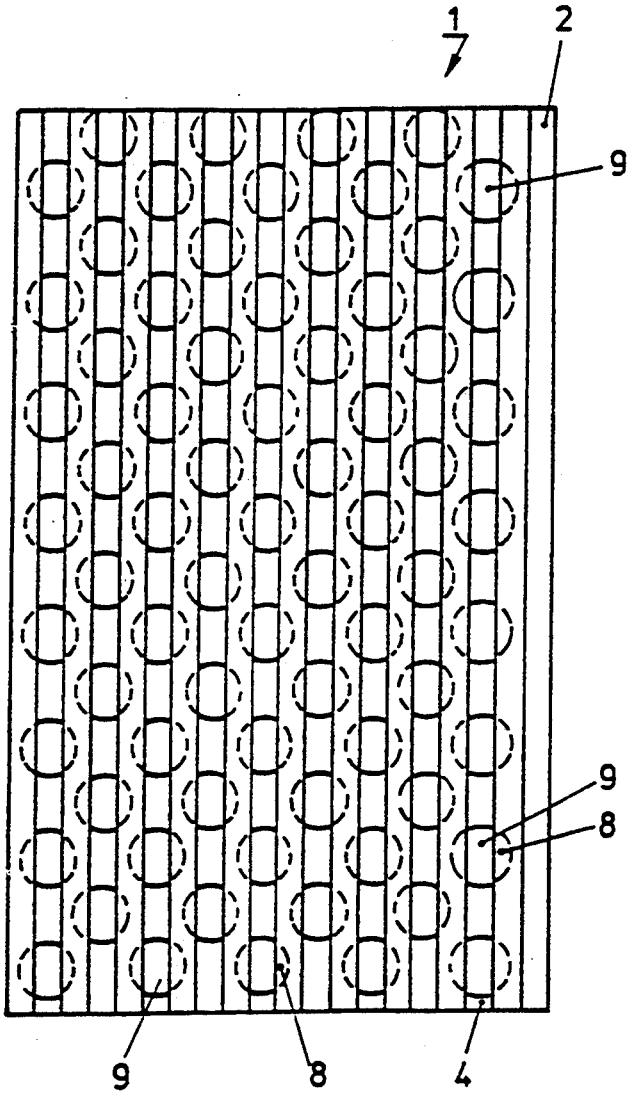
FIG. 1 is a top view of an acoustic element according to the invention.
Figure 3:
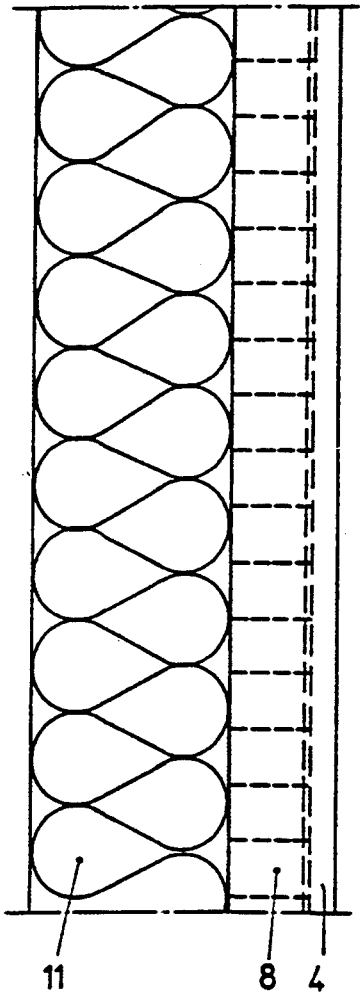
FIG. 3 is a side view of the element of FIG. 1 and FIG. 2.
Figure 2:
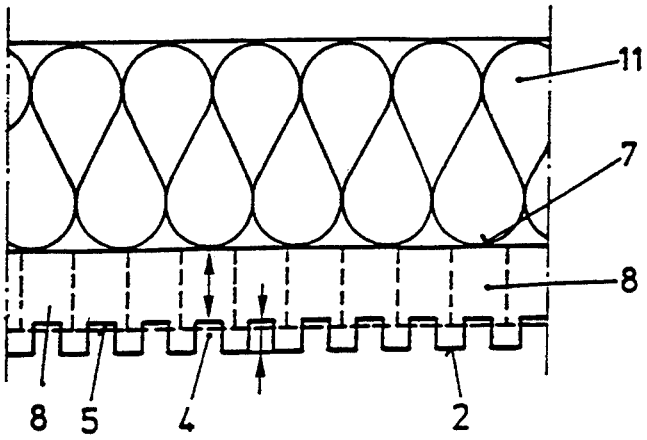
FIG. 2 is a front view of the acoustic element of FIG. 1 having a sound-absorbing glass or material wool mat.

With reference now to the drawings, the visible side of the acoustic element 1 illustrated in FIGS. 1 to 3 faces the room in which the source of sound is located. Grooves 4 extending in the longitudinal direction are set into this visible side 2, which grooves have a rectangular or square cross-section with a groove base 5 such as illustrated in FIG. 2.

The reverse side of the panel shaped acoustic element 1, the so called absorber side 7, is provided with bores 8 of which the axis of this embodiment extend in the center planes of the grooves 4 and perpendicularly to the longitudinal axis of the grooves 4. It is, however, also possible to arrange the axis of the bores 8 laterally offset and/or to drill them not perpendicularly, but obliquely relative to the longitudinal axis of the grooves 4.

While the bores 8 have a depth of about $\frac{2}{3}$ of the thickness of the plate, the depth of the grooves 4 amounts to about $\frac{1}{3}$ such as indicated and visible in FIG. 2. At the area where the grooves 4 and bores 8 overlap, passages 9 leading through the acoustics element are created through which passages 9 the energy to be attenuated penetrates from the one side of the panel therethrough to the other side.

The absorber side 7 is covered by a mineral or glass wool mat 11 or other suitable sound insulating or absorbing material, such as illustrated in FIGS. 2 and 3, which mat serves as an energy absorber, here specifically as a sound energy absorber.

Figure 4:
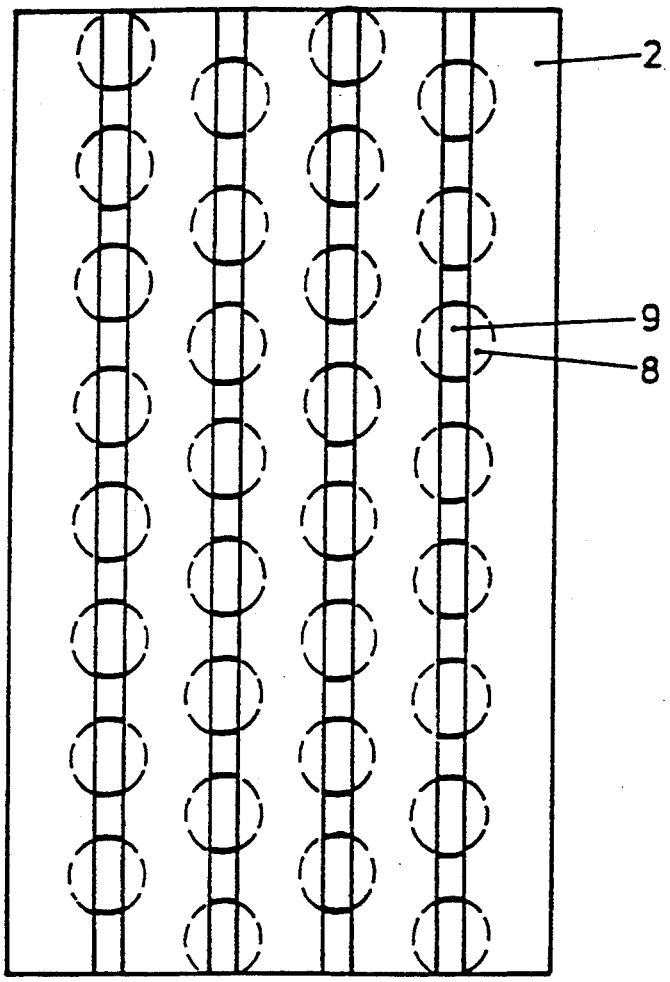
FIG. 4 illustrates a further embodiment of an acoustic element analog to FIG. 1.
Figure 5:
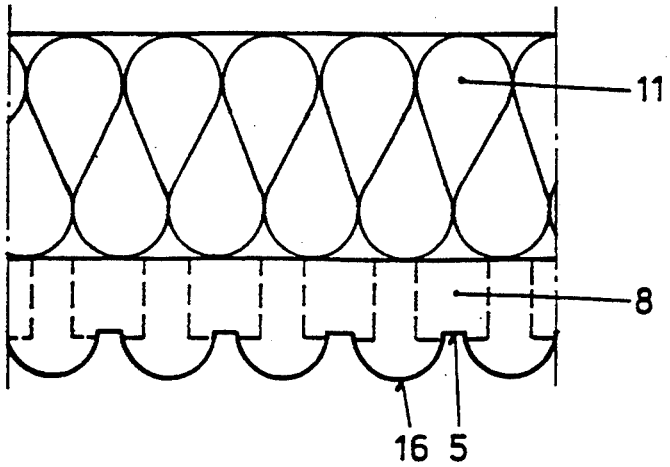
FIG. 5 is a front view of the element of FIG. 4 analog to FIG. 2.

A further pattern of the forming of the passages from the visible side of such an acoustic element as seen from the visible side is illustrated in FIGS. 4 and 5 having a differently designed raster of the bores at the absorber side and varying distances between the grooves at the visible side. Furthermore, the side areas to the groove base 5 are interconnected by rounded end cover surfaces 16 which again leads to a specific effect regarding the absorption of energy.

Figure 6:
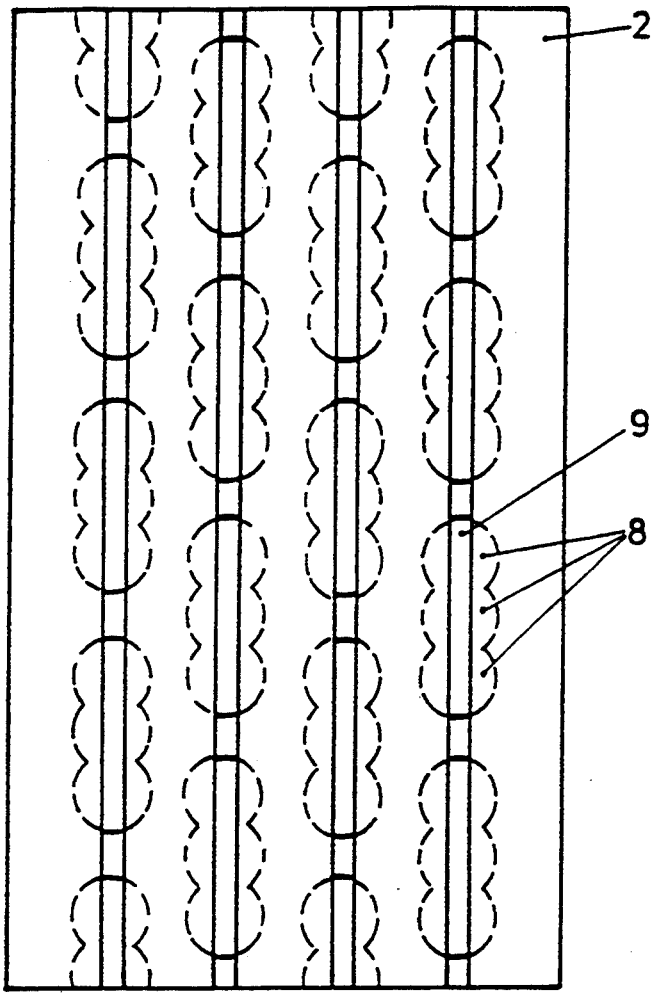
FIG. 6 illustrates a variant of an acoustic element analog to FIGS. 1 and 4.
Figure 7:
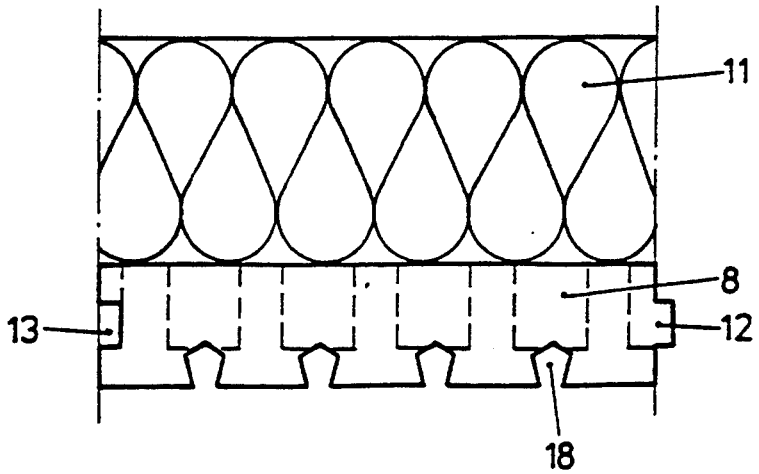
FIG. 7 is a front view of the element analog to FIG. 6.

In the embodiment of a further variant according to FIGS. 6 and 7, the longitudinal grooves at the visible side 2 of the acoustic element comprise swallowtail like cross-sections 18 and the bores 8 overlap each other in a group-like fashion such that the passages 9 have corresponding longitudinal dimensions, a further possibility to suit the object being solved is to change the shape and the location of the passages.

In FIG. 7 a lateral ridge 12 at the one longitudinal side and a corresponding groove 13 at the other longitudinal side are additionally depicted, which allow an assembling of these elements to a more or less large surface.

Figure 8:
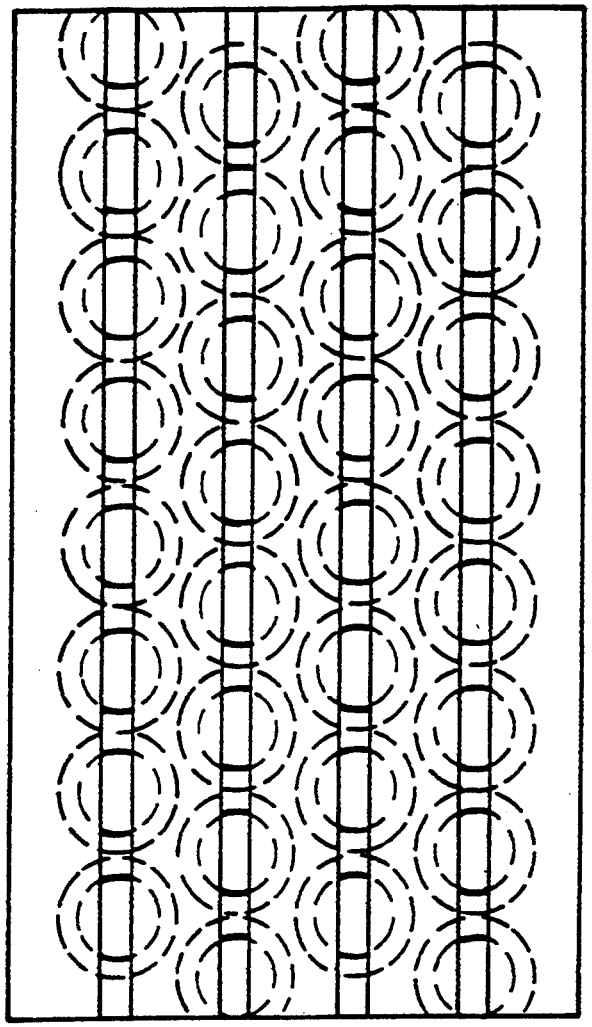
FIG. 8 illustrates a variant of an acoustic element analog to FIGS. 1 and 4.
Figure 9:
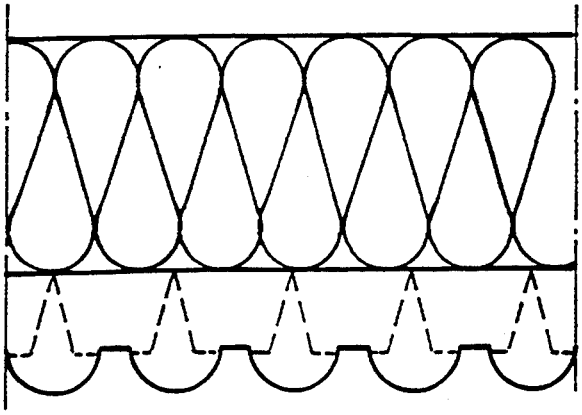
FIG. 9 is a front view of the element according to FIG. 8.

FIGS. 8 and 9 illustrate a further embodiment in which the bores are shaped as cones, truncated cones or pyramids converging toward the inside of the acoustic element.

Figure 10:
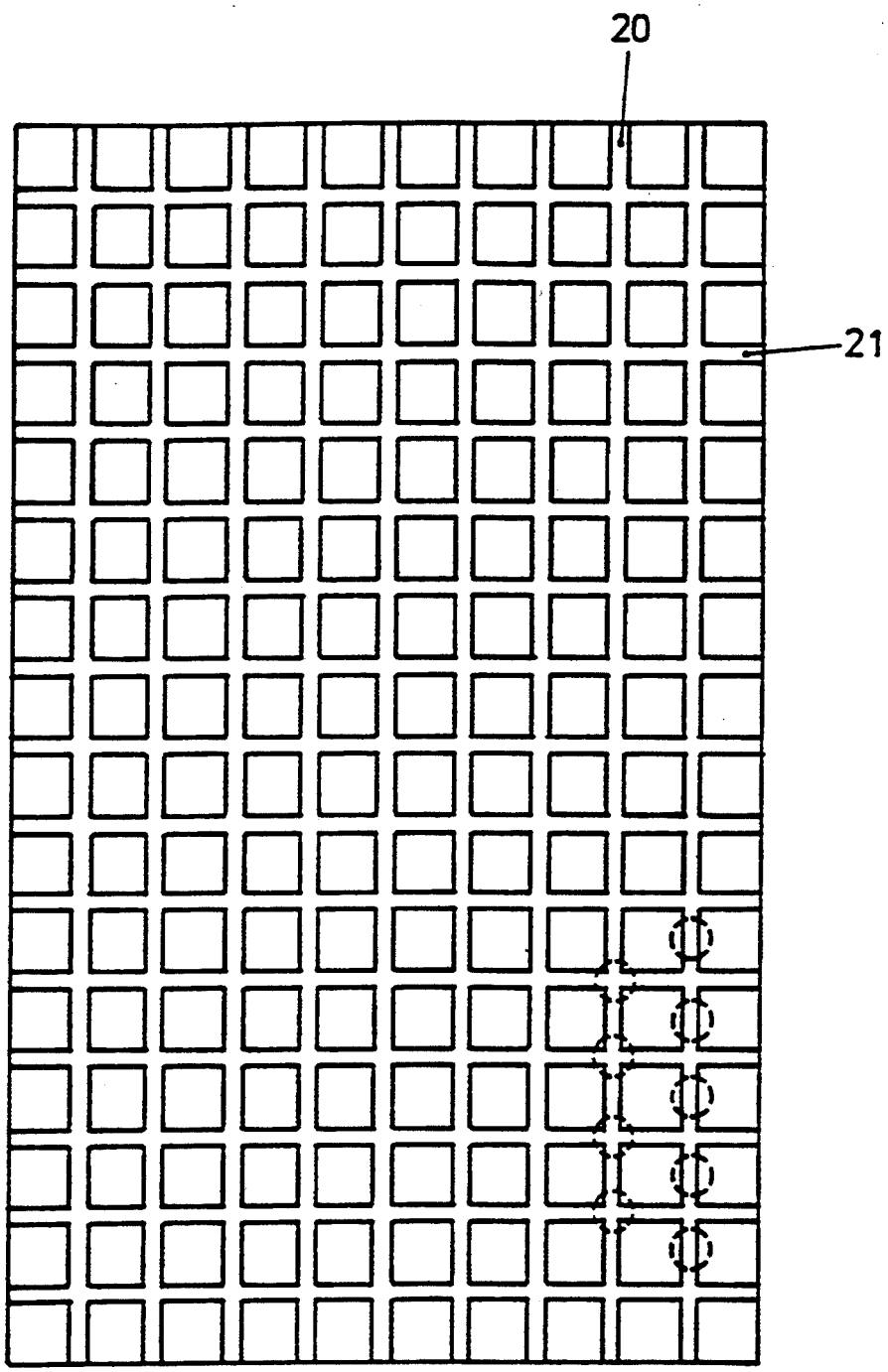
FIG. 10 is a front view of an element analog to FIG. 1 having a specifically appealing pattern of the recesses at the visible surface.
Figure 11:
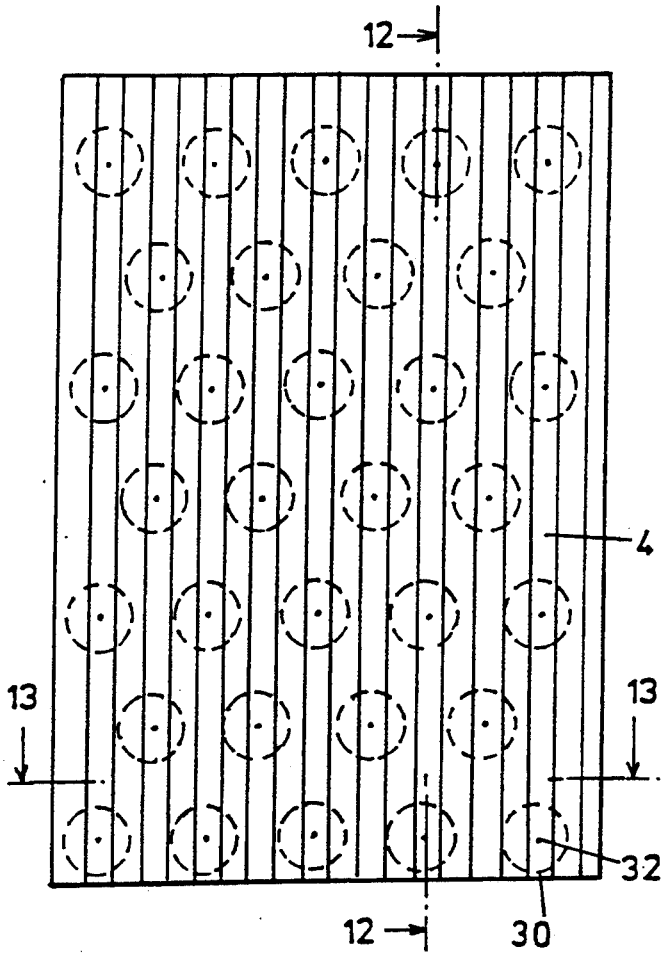
FIG. 11 is a top view of a further embodiment of the acoustic element according to the invention.
Figure 12:
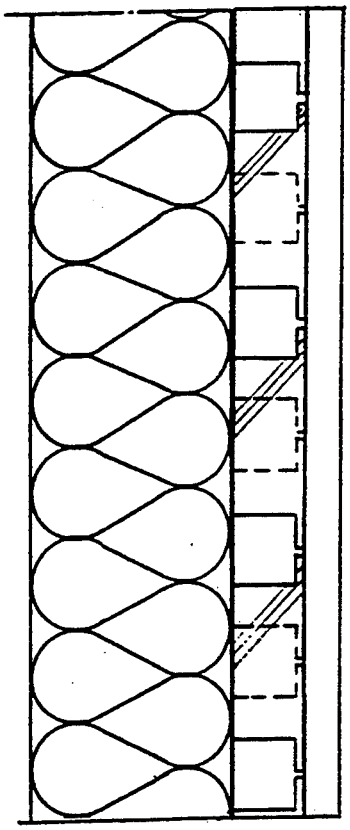
FIG. 12 is a side view taken along the line 12—12 of FIG. 11.
Figure 13:
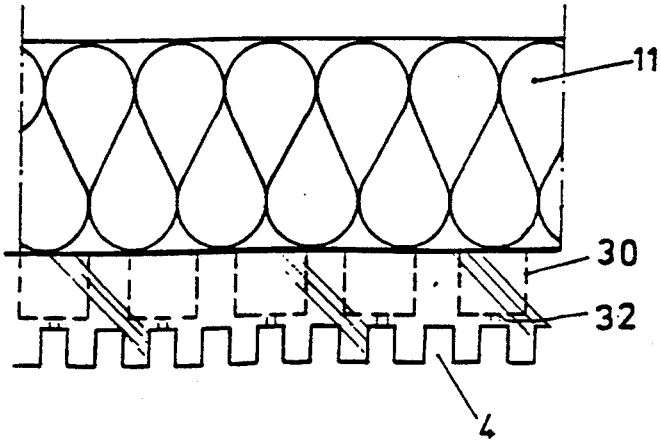
FIG. 13 is a side view taken along the line 13—13 of FIG. 11.
Figure 14:
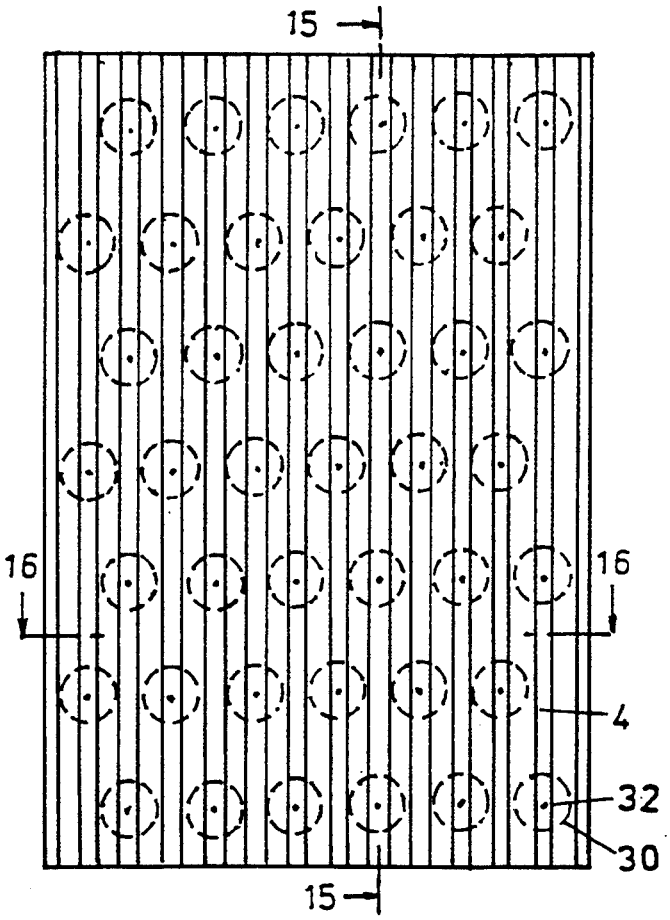
FIG. 14 shows a further embodiment of the acoustic element according to the invention in a top view.
Figure 15:
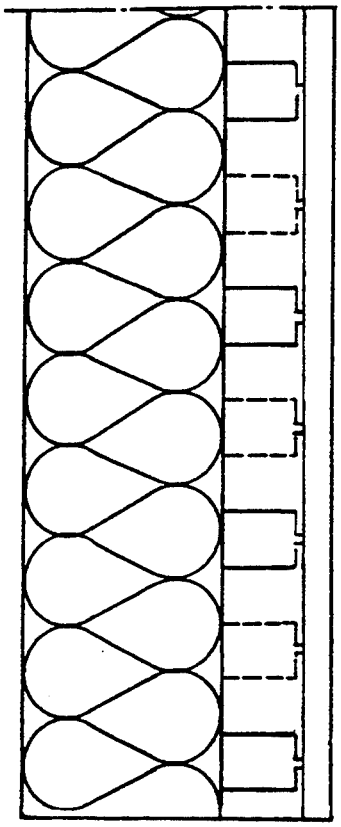
FIG. 15 is a side cross sectional view taken along the line 15—15 of FIG. 14.
Figure 16:
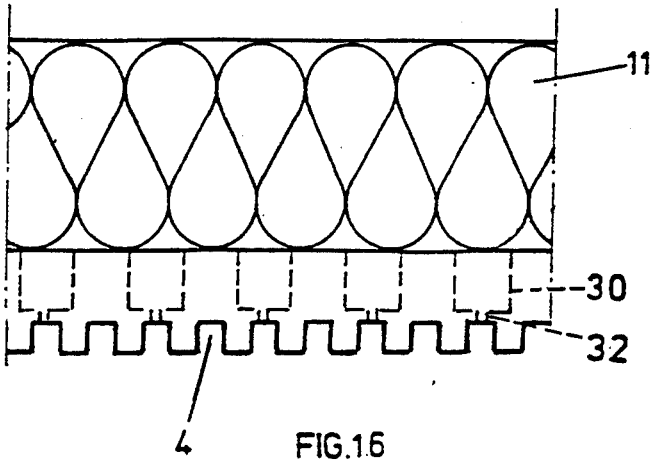
FIG. 16 is a side cross sectional view taken along the line 16—16 of FIG. 14.
Figure 17:
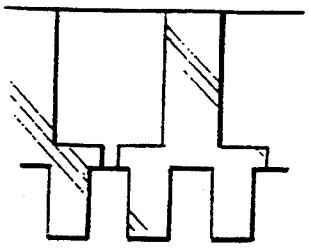
FIG. 17 shows the detail in circle 17 of FIG. 16.

FIG. 10 illustrates the front surface of an acoustic element. It is quite pleasing in that the recessed lateral and longitudinal grooves 20 and 21 form squares. The base of the grooves can possibly be colored. It obviously is also possible to design the grooves such that lying or upstanding rectangles are formed. This will depend from the specifics of the room.

In summarizing, the following is to be noted:

By a placing of differing recesses, on the one hand at the visible side and on the other hand at the absorber side of such elements and by the possibility of variations in the discussed sense, it is easily possible to change the characteristics regarding the sound attenuation and accordingly to make them to suit the local circumstances and the source of the sound.

Depending on the design of the element the absorber portion can be changed from 0 to 25% or more of the surface portion.

The sound dampening elements may be mounted in a sandwich like manner, whereby additionally a sound attenuating panel, for instance, in the form of a chipboard or plaster board, is placed onto the reverse side of the element, i.e. over the absorber mat (mineral or glass wool mat).

Such elements can also find use by a corresponding selection of material and shaping of the recess for a guiding and controlling of the sound energy, i.e. as so-called sound diffusers.

It has been proven that such acoustic elements are preferably manufactured of natural wood. By an optimal selection of massive wood the desired sound-technical effects can be optimized correspondingly. It is, however, also possible to use combined panels, such as plywood panels, chipboard panels, MDF-panels, etc.

If necessary, specifically in case of easy burning objects, to make corresponding supporting panels with cement components, for instance "Duripanel" can be used. It is also possible to realize by a corresponding selection of materials sound technical solutions on biological bases.

Such acoustic elements can be designed on a larger size basis, for instance, in lengths of up to 5 meters and widths of 100 to 200 millimeters and thicknesses of 12 to 20 millimeters. These dimensions are to be taken only as examples.

The visible side of the elements can be variably designed regarding the depth of the grooves, width of the grooves, distance between grooves, inclination of the grooves, also regarding the profile of the surface, e.g. smooth, rounded, concave, convex, etc. and can be adjusted to suit the prevailing demands. The absorber side or reverse side of the elements can be also be made to suit these demands with regard to position of the bores, depth of the bores, e.g. conical bores, diameter of bores and arrangement of the bores and shape of the bores, as well. By the combination of the grooves or profile, resp. at the visible side and perforations of the mentioned kind at the reverse side, a respective optimal characteristic for solving a problem encountered may be achieved.

The surfaces of such elements can be varied as desired, i.e. they may be natural surface, lacquered, stained, enamelled, lacquer coated, painted, etc.

FIGS. 11–20 show further embodiments according to the present invention showing different variations of the invention. In these embodiments, the bores change from a larger diameter 30 on the inside facing the sound absorbing material 11 to a smaller diameter 32 before intersecting the grooves 4. As shown in the figures, the bores 30–32 are arranged in a staggered fashion. Staggering of the bores helps to achieve a better and more efficient "packing" of the bores on the acoustic element, in addition to providing a visual effect.

In the embodiment of FIGS. 14–17, the grooves are narrowed and arranged more closely together, with the bores 30–32 being smaller and arranged more closely together in the horizontal direction, and more spaced apart in the vertical direction.

Figure 18:
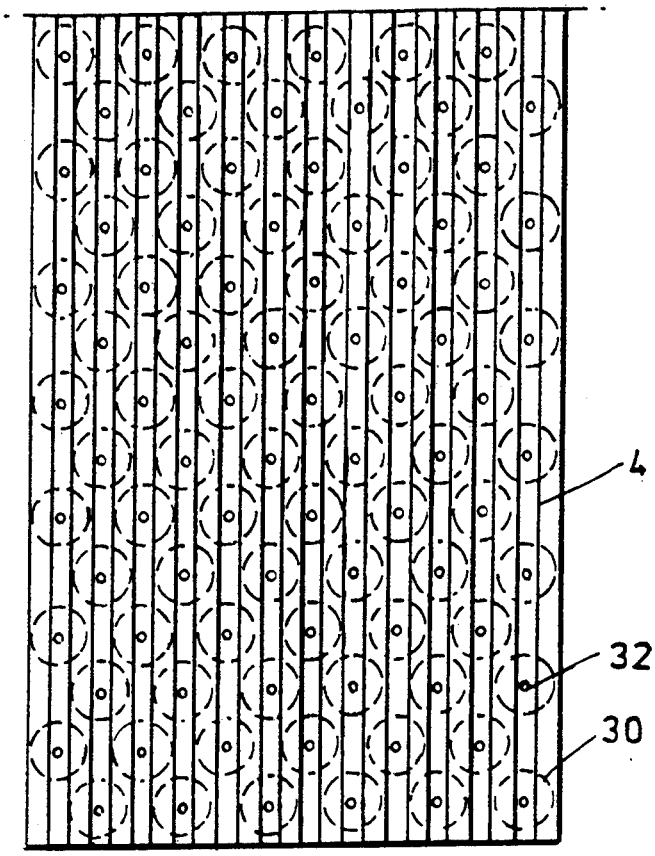
FIG. 18 shows a further embodiment of the acoustic element according to the invention in a top view.
Figure 19:
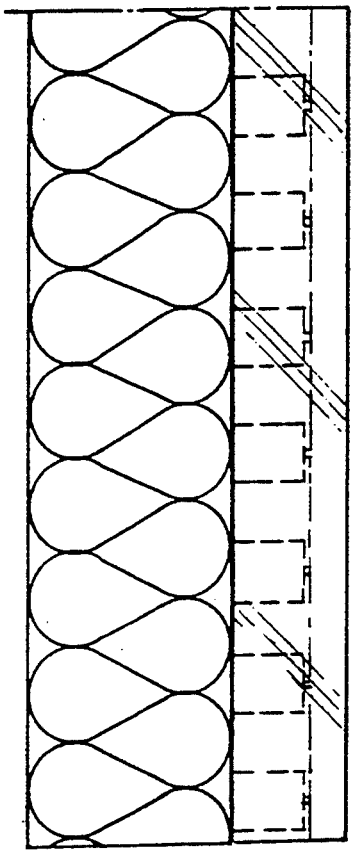
FIG. 19 is a side cross sectional view of the acoustic element shown in FIG. 18 taken along the line 19—19 of FIG. 18.
Figure 20:
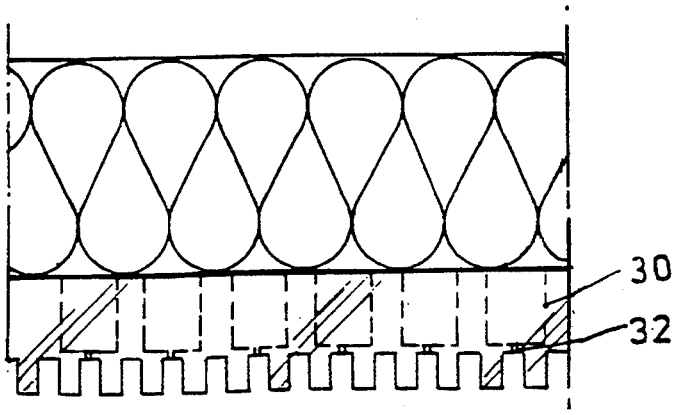
FIG. 20 is a side cross sectional view taken along the line 20—20 of FIG. 18.
Figure 21:
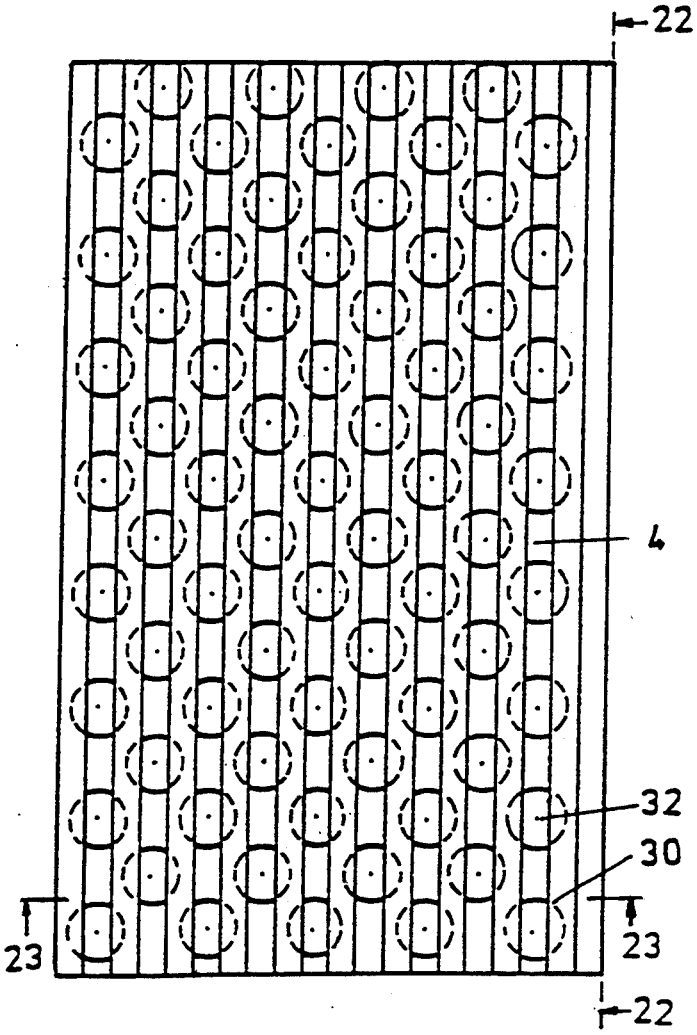
FIG. 21 is a further embodiment of the acoustic element according to the present invention showing a top view thereof.
Figure 22:
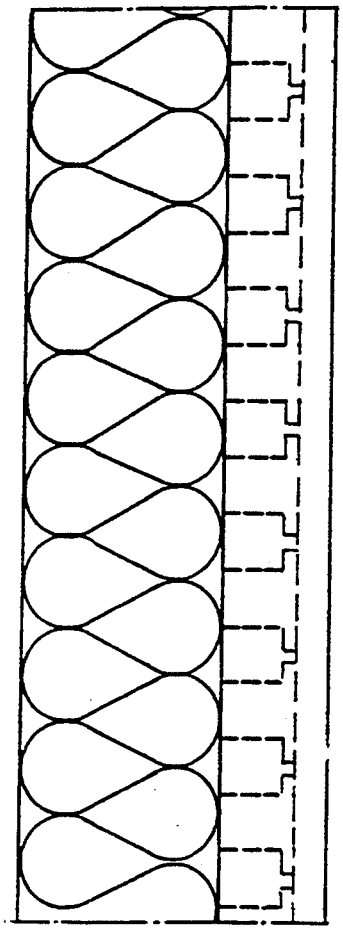
FIG. 22 is a side cross sectional view of the acoustic element shown in FIG. 21 taken along the line 22—22 thereof.
Figure 23:
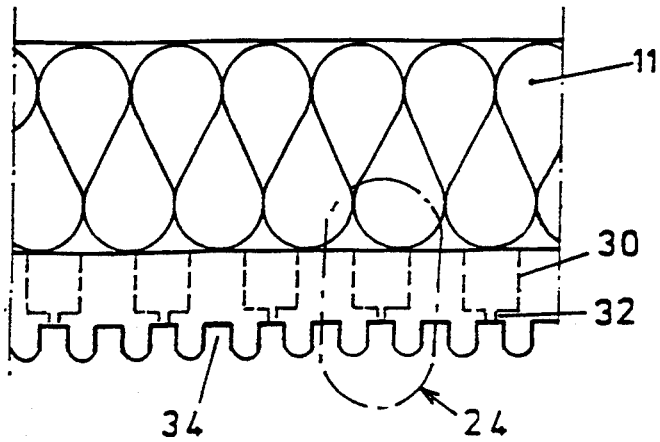
FIG. 23 is a side cross sectional view taken along the line 23—23 of FIG. 21.
Figure 24:
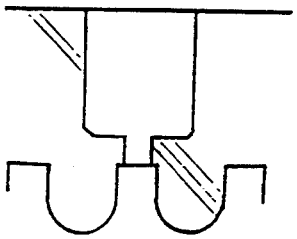
FIG. 24 is a detail of the enclosed area 24 in FIG. 23.
Figure 25:
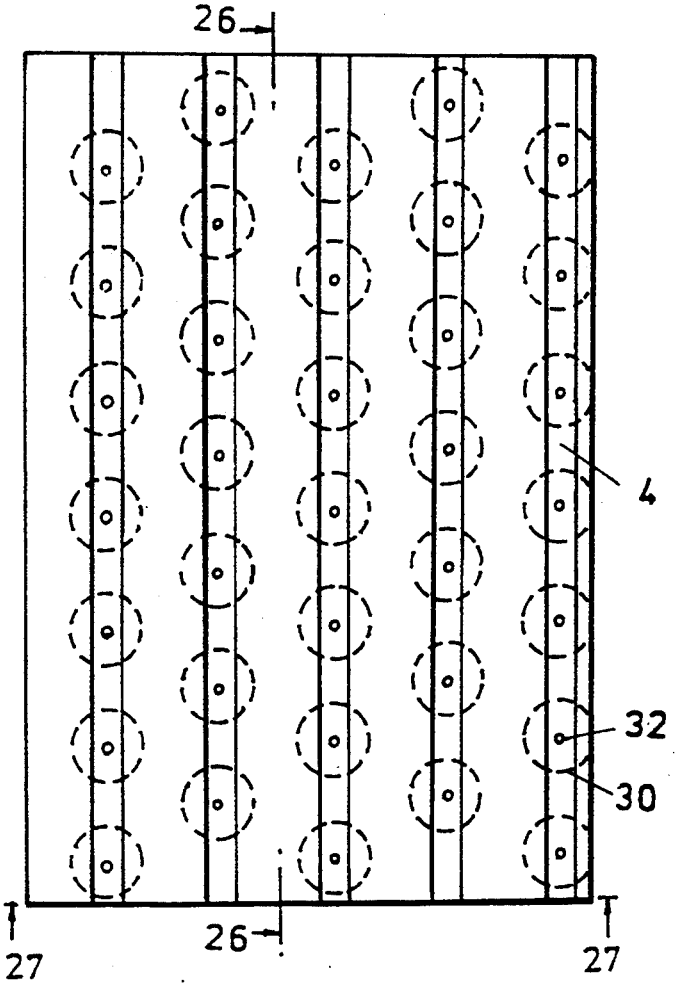
FIG. 25 is a top view of a further embodiment of an acoustic element according to the present invention.
Figure 26:
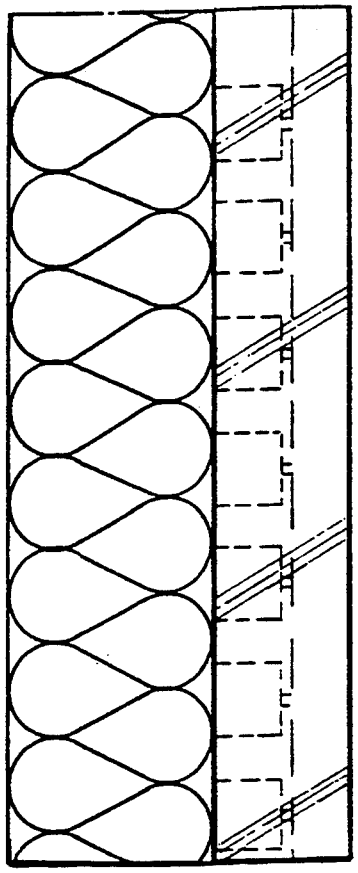
FIG. 26 is a side cross sectional view taken along the line 26—26 of FIG. 25.
Figure 27:
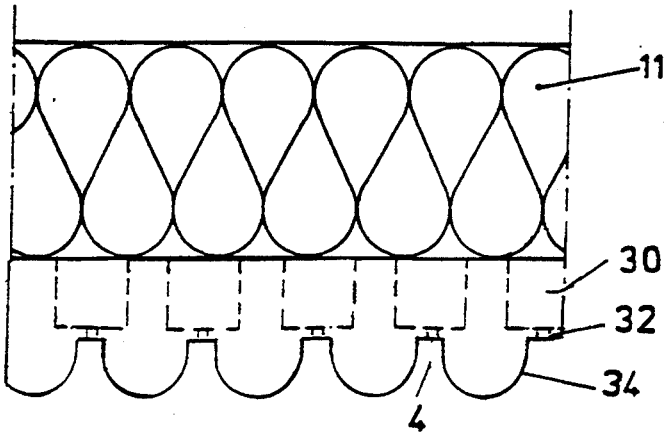
FIG. 27 is a side cross sectional view taken along the line 27—27 of FIG. 25.

In the embodiment of FIGS. 18–20, the bores 30–32 are spaced even more closely together in both the vertical and horizontal directions.

FIGS. 21–24 and 25–27 show further related embodiments according to the present invention. In these embodiments, the bores have a first diameter 30 changing to a smaller diameter 32 before intersecting the grooves 4. Between the grooves 4, the surfaces are rounded, as shown at 34, providing a pleasing effect as well as a softer appearance and added safety.

Figure 28:
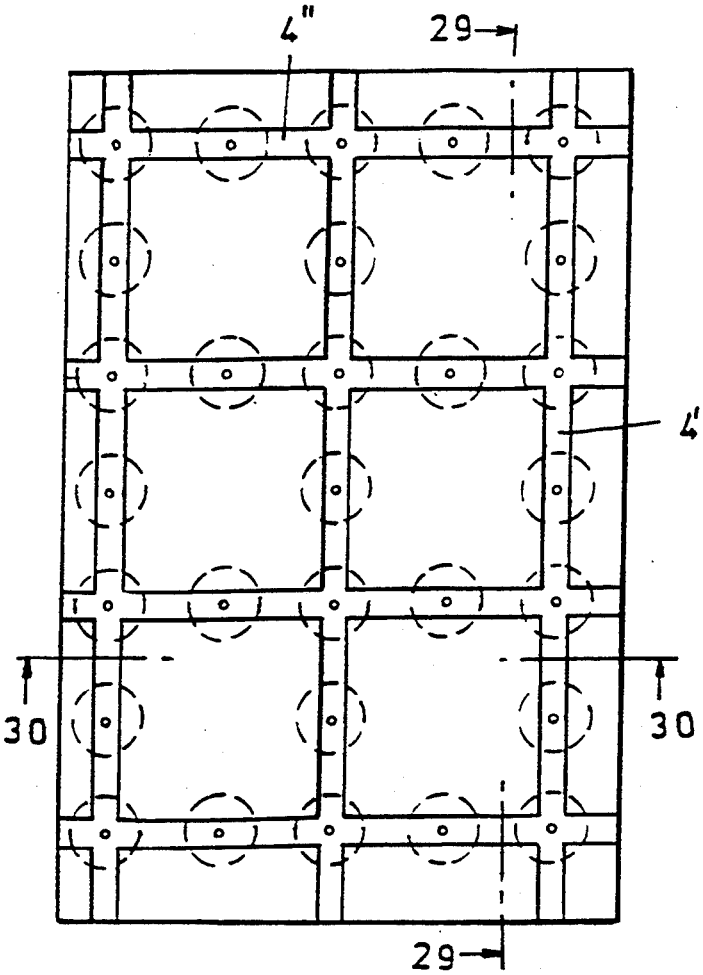
FIG. 28 is a further embodiment showing the top view of the acoustic element according to the present invention.
Figure 29:
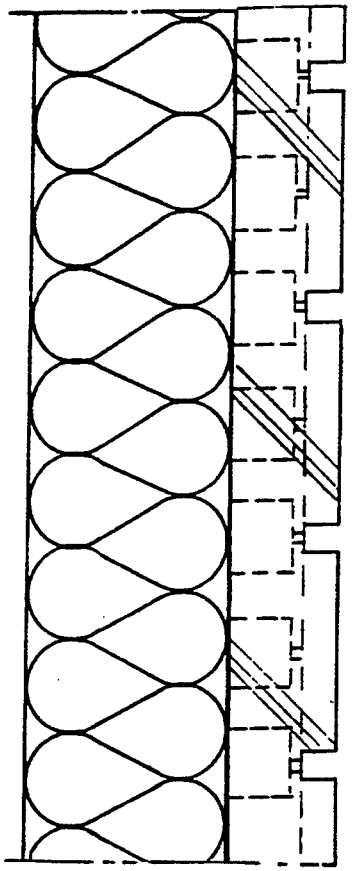
FIG. 29 is a side cross sectional view of the acoustic element of FIG. 28 taken along the line 29—29 of FIG. 28.
Figure 30:
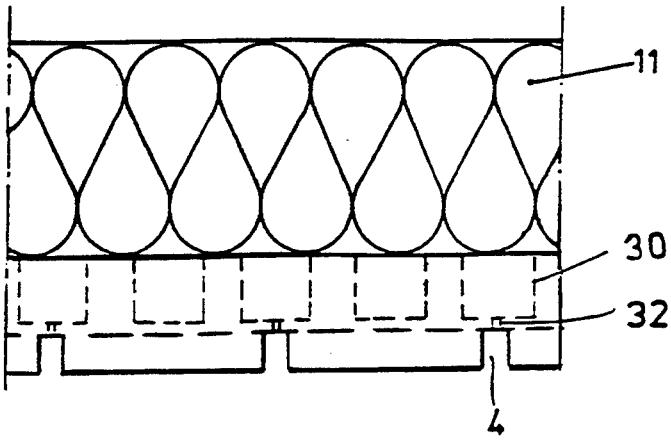
FIG. 30 is a side cross sectional view taken along line 30—30 of FIG. 28.

FIGS. 28–30 show a further embodiment according to the present invention. In this embodiment, a series of vertical grooves 4' and horizontal grooves 4'' are provided. As in the embodiments of FIGS. 11–27, the bores have a first larger diameter 30 adjacent the sound absorbing material 11 changing to a smaller diameter 32 before intersection with the grooves 4' and 4''. The bores in the embodiment shown are not staggered, although they can be staggered. As shown in the embodiment, the bores are provided at the intersections of the grooves as well as between the intersections in the grooves.

Figure 31:
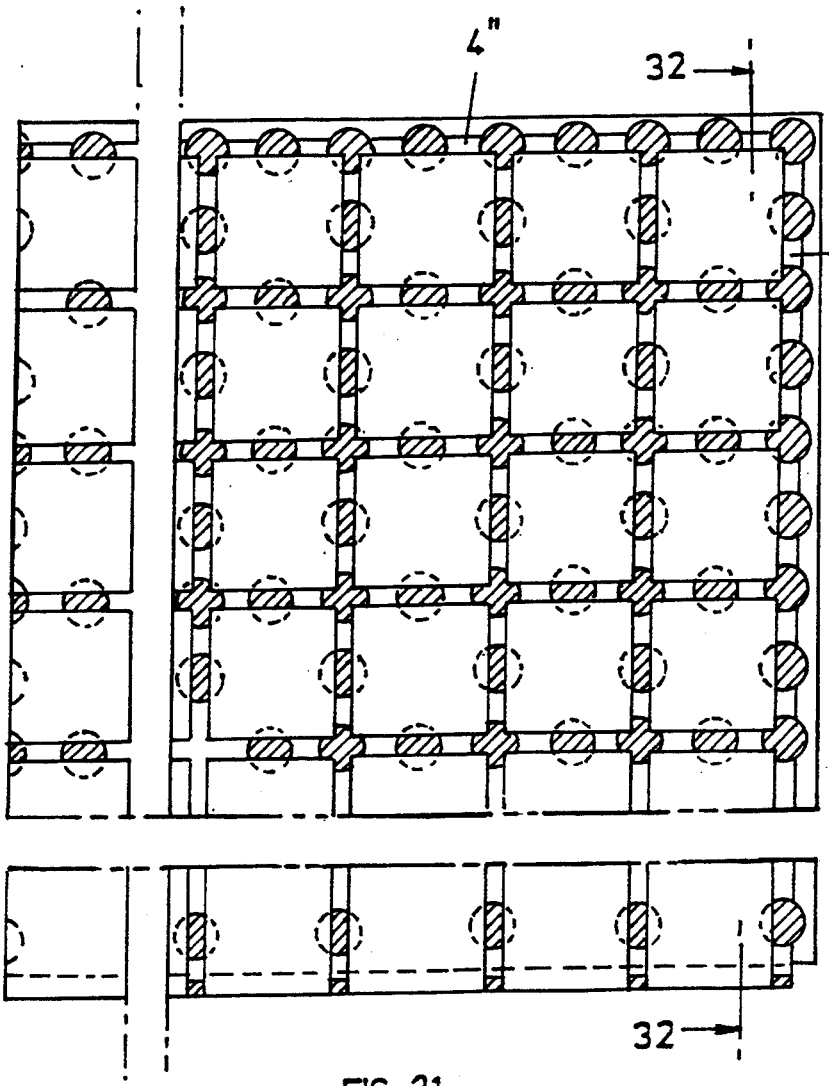
FIG. 31 shows a further embodiment of the acoustic element according to the present invention.
Figure 32:
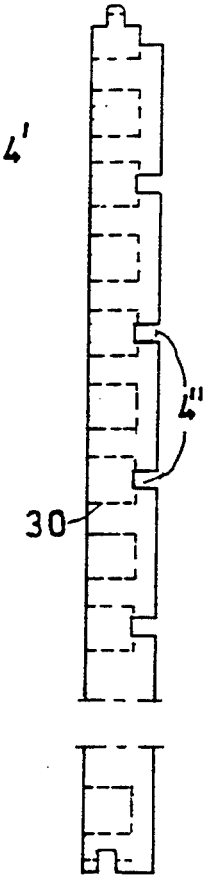
FIG. 32 is a cross sectional side view taken along the line 32—32 of FIG. 31.

In the embodiment of FIGS. 31 and 32, the bores have a larger diameter 30 extending and intersecting with the grooves 4' and 4'', thus forming slot shaped openings, in much the same way as in the embodiments of FIGS. 1–5.

Figure 33:
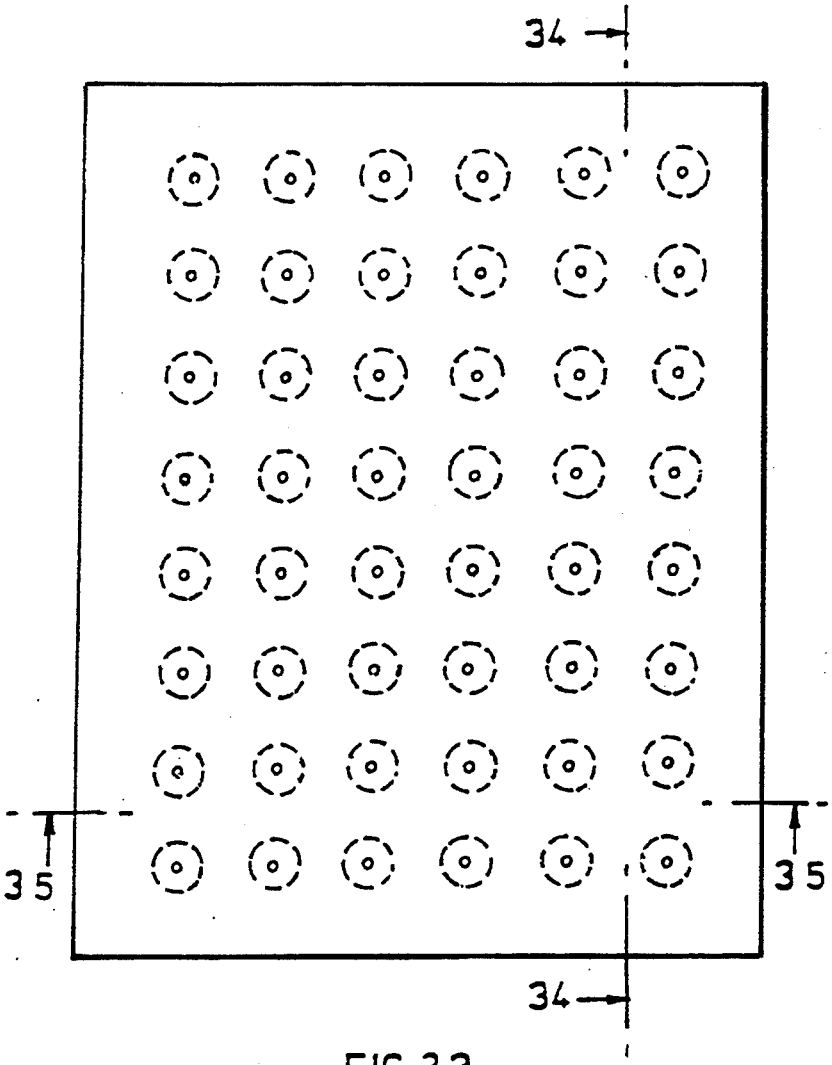
FIG. 33 is a top view of a further embodiment of the acoustic element according to the present invention.
Figure 34:
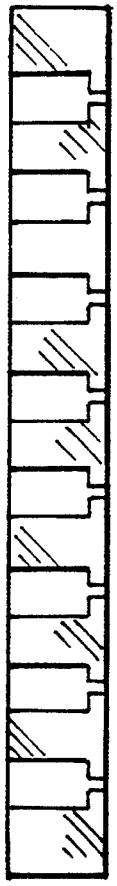
FIG. 34 is a side cross sectional view taken along the line 34—34 of FIG. 36.
Figure 35:
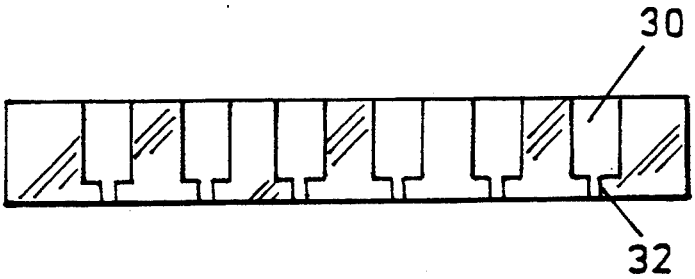
FIG. 35 is a side cross sectional view taken along the line 35—35 of FIG. 33.

In the embodiment according to FIGS. 33–35, no grooves are provided. Instead, the bores have a first diameter 30 changing to a smaller diameter 32 at the external surface of the acoustic element.

While there are shown and described presently preferred embodiments of the invention, it is to be understood that the invention is not limited thereto, but may be otherwise variously embodied and practiced within the scope of the following claims.

What is claimed is:

1. A sound absorbing panel having a front surface and rear surface, the front surface having a plurality of parallel grooves therein, the grooves having a depth and a width, the rear surface having for each groove in the front surface, a row of bores aligned with respect to the groove, each bore extending into the sound absorbing panel toward the groove and having a first diameter to a depth below the depth of the grooves, and thereafter having a second smaller diameter and extending into the groove, thereby communicating with the respective one of the grooves, the second diameter being smaller than the width of the grooves.

2. The sound absorbing panel recited in claim 1, wherein the bores are arranged in adjacent rows, the bores in the adjacent rows being staggered.

3. The sound absorbing panel recited in claim 1, wherein the front surface has areas between the grooves, said areas between the grooves having sharply defined corners where the areas abut with the grooves.

4. The sound absorbing panel recited in claim 1, wherein the front surface has areas between the grooves, said areas between the grooves being rounded.

5. The sound absorbing panel recited in claim 1, wherein the panel is arranged in a plane, further comprising a plurality of parallel grooves in two dimensions perpendicular to each other in the plane of the panel, thus forming a plurality of intersecting grooves.

6. The sound absorbing panel recited in claim 5, wherein the bores are provided at intersections of the grooves and at locations between said intersections.

7. The sound absorbing panel recited in claim 1, wherein the bores are centered with respect to the corresponding groove.

8. A sound absorbing panel having a front surface and a rear surface and arranged in a plane, the front surface having a plurality of parallel grooves in two dimensions perpendicular to each other in the plane of the panel, the perpendicular grooves having a plurality of intersections, the grooves having a depth and a width, the rear surface having, for each groove in the front surface, a row of bores aligned with respect to the groove, each bore having a bottom, a portion of the bottom of each bore opening into and communicating with the respective one of the grooves, the bottom of each bore opening into and communicating with the respective one of the grooves having a diameter where the bore meets the respective groove which is larger than the width of the groove, the bores being located at respective ones of the intersections of the grooves disposed in the two dimensions perpendicular to each other.

9. The sound absorbing panel recited in claim 8, further comprising bores located in the grooves between the intersections of the grooves disposed in the two perpendicular dimensions.

10. The sound absorbing panel recited in claim 8, wherein the bores aligned with the grooves are centered with respect to the corresponding groove.

11. A sound absorbing panel having a front surface and a rear surface, the front surface having a plurality of first bores therein which do not extend completely through the panel and each having a diameter, the rear surface having for each first bore in the front surface a respective second bore having a diameter larger than the diameter of the first bore aligned with and centered with respect to the first bore, the second bores each having a bottom, a portion of the bottom of each second bore opening into and communicating with the respective one of the first bores.

* * * * *